US012000032B2

(12) United States Patent
Luo et al.

(10) Patent No.: US 12,000,032 B2
(45) Date of Patent: Jun. 4, 2024

(54) SUPERALLOY SEAMLESS TUBE AND PREPARATION METHOD THEREOF

(71) Applicant: JIANGSU UNIVERSITY, Zhenjiang (CN)

(72) Inventors: Rui Luo, Zhenjiang (CN); Zhizhong Yuan, Zhenjiang (CN); Xiaonong Cheng, Zhenjiang (CN); Pei Gao, Zhenjiang (CN); Leli Chen, Zhenjiang (CN); Tian Liu, Zhenjiang (CN)

(73) Assignee: JIANGSU UNIVERSITY (CN)

( * ) Notice: Subject to any disclaimer, the term of this patent is extended or adjusted under 35 U.S.C. 154(b) by 611 days.

(21) Appl. No.: 17/251,935

(22) PCT Filed: Jun. 4, 2020

(86) PCT No.: PCT/CN2020/094389
§ 371 (c)(1),
(2) Date: Dec. 14, 2020

(87) PCT Pub. No.: WO2020/259246
PCT Pub. Date: Dec. 30, 2020

(65) Prior Publication Data

US 2021/0292879 A1 Sep. 23, 2021

(30) Foreign Application Priority Data

Jun. 24, 2019 (CN) ..... 201910549138.X

(51) Int. Cl.

| | |
|---|---|
| ***C22F 1/16*** | (2006.01) |
| ***B21C 37/06*** | (2006.01) |
| ***C21D 1/26*** | (2006.01) |
| ***C21D 8/02*** | (2006.01) |
| ***C21D 8/10*** | (2006.01) |
| ***C21D 9/08*** | (2006.01) |
| ***C22C 30/00*** | (2006.01) |

(52) U.S. Cl.
CPC ..... *C22F 1/16* (2013.01); *B21C 37/06* (2013.01); *C21D 1/26* (2013.01); *C21D 8/0236* (2013.01); *C21D 8/105* (2013.01); *C21D 9/08* (2013.01); *C22C 30/00* (2013.01)

(58) Field of Classification Search
CPC .. B21C 37/06; C21D 9/08; C21D 1/26; C21D 8/0236; C21D 8/105; C22F 1/16
See application file for complete search history.

(56) References Cited

FOREIGN PATENT DOCUMENTS

| | | | | | |
|---|---|---|---|---|---|
| CN | 1463296 | A | | 12/2003 | |
| CN | 108467973 | A | * | 8/2018 | ..... C22C 19/055 |
| CN | 108467973 | A | | 8/2018 | |
| CN | 110218940 | A | | 9/2019 | |
| JP | 2004197150 | A | * | 7/2004 | |
| JP | 2004197150 | A | | 7/2004 | |
| JP | 2016132019 | A | | 7/2016 | |

OTHER PUBLICATIONS

Machine translation via J-Platpat (https://www.j-platpat.inpit.go.jp/) of JP 2004-197150A; Translated Apr. 25, 2023. (Year: 2004).*
Patent Cooperation Treaty, "International Search Report for PCT Patent Application No. PCT/CN2020/094389", Mailed Date: Sep. 3, 2020, 5 pages.

* cited by examiner

*Primary Examiner* — Nicholas A Wang
*Assistant Examiner* — Jacob J Gusewelle
(74) *Attorney, Agent, or Firm* — Eschweiler & Potashnik, LLC

(57) ABSTRACT

A superalloy seamless pipe and a preparation method thereof are provided. The superalloy seamless pipe comprises the following components in percentages by weight: C: 0.01-0.06%, Si: 0.40-1.00%, Mn: 0.30-1.00%, P≤0.025%, S≤0.020%, Cr: 15.00-17.00%, Ni: 44.00-46.00%, Al: 2.90-3.90%, Ce: 0.01-0.03%, Ti: 0.10-0.30%, N: 0.03-0.08%, and the balance of Fe and inevitable impurities.

15 Claims, No Drawings

SUPERALLOY SEAMLESS TUBE AND PREPARATION METHOD THEREOF

CROSS REFERENCE TO RELATED APPLICATION

This application is a national stage entry of PCT application No. PCT/CN2020/094389, filed on Jun. 4, 2020. That application, in turn, claims priority to Chinese Application No. 201910549138.X, entitled "superalloy seamless tube and preparation method thereof" filed with the China National Intellectual Property Administration on Jun. 24, 2019, each of these are hereby incorporated by reference in their entirety.

TECHNICAL FIELD

The present disclosure relates to the technical field of superalloy, and particularly to a superalloy seamless tube and a preparation method thereof.

BACKGROUND

Iron-nickel-based precipitation hardened and wrought superalloys are widely used in aerospace, nuclear power, petrochemical, metallurgy, and other fields due to their good high-temperature strength, structural stability, high-temperature oxidation resistance, and corrosion resistance, for example high-temperature oxidation resistance parts in combustion chambers of aerospace engines, rolls for industrial furnace, transmission devices, thermowells and other high-temperature resistant parts.

At present, the commonly used iron-nickel-based precipitation hardened and wrought superalloy is GH2747, but the research on GH2747 at home mainly focuses on the introduction of physical and chemical properties, while rarely on the industrialized production of seamless tubes. On the other hand, with the increasing requirements for the use of iron-nickel-based precipitation hardened and wrought superalloy for aviation and aerospace engines, the development of more superalloy seamless tubes has an important guiding significance for the production and application of the materials.

SUMMARY

An objective of the present disclosure is to provide a superalloy seamless tube and a preparation method thereof, and the superalloy seamless tube has high temperature resistance, oxidation corrosion resistance, high tensile strength and high yield strength, and has small surface roughness, good dimensional accuracy and surface quality, which could meet requirements for iron-nickel-based precipitation hardened and wrought superalloy seamless tubes in terms of aerospace engines.

In order to achieve the above objective, the present disclosure provides the following technical solutions:

The present disclosure provides a superalloy seamless tube, comprising the following components in percentages by weight: C: 0.01-0.06%, Si: 0.40-1.00%, Mn: 0.30-1.00%, P≤0.025%, S≤0.020%, Cr: 15.00-17.00%, Ni: 44.00-46.00%, Al: 2.90-3.90%, Ce: 0.01-0.03%, Ti: 0.10-0.30%, N: 0.03-0.08%, and the balance of Fe and inevitable impurities.

In some embodiments, the superalloy seamless tube has an inner surface roughness Ra of not larger than 1.6 μm, an outer surface roughness Ra of not larger than 1.0 μm, an outer diameter of 25±0.05 mm, a wall thickness of 3±0.05 mm, a curvature of not larger than 0.8 mm/m, and a grain size of not less than grade 5.

In some embodiments, the superalloy seamless tube exhibits the following room-temperature mechanical properties: $R_m$≥600 MPa, $R_{p0.2}$≥210 MPa, $A_{50}$≥35%.

In some embodiments, the superalloy seamless tube exhibits the following high-temperature mechanical properties: at 100° C., $R_m$≥540 MPa, $R_{p0.2}$≥195 MPa, A≥35%; at 200° C., $R_m$≥530 MPa, $R_{p0.2}$≥190 MPa, A≥35%; at 300° C., $R_m$≥520 MPa, $R_{p0.2}$≥170 MPa, A≥40%; at 400° C., $R_m$≥510 MPa, $R_{p0.2}$≥160 MPa, A≥40%; at 500° C., $R_m$≥480 MPa, $R_{p0.2}$≥150 MPa, A≥45%; at 600° C., $R_m$≥420 MPa, $R_{p0.2}$≥150 MPa, A≥25%; at 700° C., $R_m$≥320 MPa, $R_{p0.2}$≥150 MPa, A≥10%; at 800° C., $R_m$≥150 MPa, $R_{p0.2}$≥140 MPa, A≥50%; at 900° C., $R_m$≥80 MPa, $R_{p0.2}$≥70 MPa, A≥50%.

The present disclosure provides a method for preparing the superalloy seamless tube as described in the above technical solutions, comprising:

(1) smelting and forging an alloy for achieving components of the superalloy seamless tube as described in the above technical solutions, to obtain a tube blank;

(2) subjecting the tube blank to a hot piercing, to obtain a crude tube;

(3) subjecting the crude tube to a first solution heat treatment and a cold rolling in sequence, to obtain an intermediate tube blank;

(4) subjecting the intermediate tube blank to a second solution heat treatment and a cold rolling in sequence, to obtain a preliminary alloy tube; and (5) subjecting the preliminary alloy tube to a third solution heat treatment, to obtain a superalloy seamless tube.

In some embodiments, in step (1), the tube blank has an outer diameter of 70 mm.

In some embodiments, in step (2), the crude tube has a dimension of Φ70×7 mm, an outer-diameter deviation of (−1.50, +1.00) mm, and a wall-thickness deviation of ±0.50 mm.

In some embodiments, in step (3), the intermediate tube blank has a dimension of Φ38×4 mm, an outer-diameter deviation of 0.15 mm, and a wall-thickness deviation of 0.1 mm.

In some embodiments, in step (4), the preliminary alloy tube has a dimension of Φ25×3 mm, an outer-diameter deviation of ±0.05 mm, and a wall-thickness deviation of 0.05 mm.

In some embodiments, in step (3), the first solution heat treatment is performed at a temperature of 1000-1060° C. for 25-30 minutes, and the cooling in the solution heat treatment is carried out by a water cooling.

In some embodiments, in steps (3) and (4), the cold rolling is performed independently at a feed rate of 2-3 mm/time, and independently at a speed of 20-30 times/minute.

In some embodiments, in step (4), the second solution heat treatment is performed at a temperature of 1000-1060° C. for 8-12 minutes, and the cooling in the solution heat treatment is carried out by a water cooling.

In some embodiments, the method further comprises in step (4), before the second solution heat treatment, subjecting the intermediate tube blank to a first acid pickling. In some embodiments, the method further comprises subjecting the intermediate tube blank after the second solution heat treatment to a second acid pickling.

In some embodiments, an acid used in the first acid pickling is a mixed liquid of hydrofluoric acid and nitric acid, wherein a mass concentration of hydrofluoric acid in the mixed liquid is in a range of 1-3%, and a mass concentration of nitric acid in the mixed liquid is in a range of 10-15%.

In some embodiments, an acid used in the second acid pickling is a mixed liquid of hydrofluoric acid and nitric acid, wherein a mass concentration of hydrofluoric acid in the mixed liquid is in a range of 5-8%, and a mass concentration of nitric acid in the mixed liquid is in a range of 10-15%.

In some embodiments, in step (5) the third solution heat treatment is performed at a temperature of 1000-1060° C. for 5-10 minutes, and the cooling therein is carried out by a water cooling.

In some embodiments, the method further comprises: in step (5), before the third solution heat treatment, subjecting the preliminary alloy tube to a third acid pickling, wherein an acid used in the third acid pickling is a mixed liquid of hydrofluoric acid and nitric acid, wherein a mass concentration of hydrofluoric acid in the mixed liquid is in a range of 1-3%, and a mass concentration of nitric acid in the mixed liquid is in a range of 10-15%.

In some embodiments, the method further comprises subjecting the alloy tube after the third solution heat treatment to a post-treatment and an inspection, wherein the post-treatment comprises a straightening and a fine polishing in sequence, and the inspection comprises an ultrasonic inspection, an eddy-current inspection, a hydraulic inspection, a surface inspection, a dimension inspection, and a physical-chemical inspection.

The present disclosure provides a superalloy seamless tube, comprising the following components in percentages by weight: C: 0.01-0.06%, Si: 0.40-1.00%, Mn: 0.30-1.00%, P≤0.025%, S≤0.020%, Cr: 15.00-17.00%, Ni: 44.00-46.00%, Al: 2.90-3.90%, Ce: 0.01-0.03%, Ti: 0.10-0.30%, N: 0.03-0.08%, and the balance of Fe and inevitable impurities. Compared with GH2747 alloy, the superalloy seamless tube has reduced C content such that its intergranular corrosion resistance is improved; with Si and Mn contents controlled within a certain range and N element increased by a certain amount, the decrease in strength caused by the reduced C content could be compensated; in addition, the appropriate amounts of Al and Ti added in the superalloy seamless tube, in combination with other components can reduce grain boundary precipitates, and meanwhile produce carbides of Ti in a certain amount, thereby reducing the C content in the matrix and improving intergranular corrosion resistance of the seamless tube; a small amount of rare earth Ce added, in combination with other components could reduce the amount of non-metallic inclusions in the alloy and reduce their dimension, thus purifying the melt and helping to improve the processing and use performance. In the present disclosure, the combined effect of each component makes the superalloy seamless tube have high temperature resistance, oxidation corrosion resistance, high tensile strength and high yield strength, which can fully meet the mechanical performance requirements for superalloy seamless tubes in terms of aerospace engines.

The present disclosure further provides a method for preparing the superalloy seamless tube as described in the above technical solution. With the method of the present disclosure, it is possible to prepare the seamless tube having good dimensional accuracy and surface quality, and realize industrialized production, under the premise of ensuring the performance of the seamless tube. The general requirements of seamless tubes include: an inner and outer surface roughness Ra≤3.2 μm, an outer diameter of small-diameter precision tubes of the general requirement 0.10 mm, a wall-thickness deviation of ±10%, and a curvature of not larger than 1.5 mm/m; while for the seamless tube of the present disclosure, an inner surface roughness Ra≤1.6 μm, an outer surface roughness Ra≤1.0 μm, an outer-diameter deviation of ±0.05 mm, a wall-thickness deviation of ±0.05 mm, and a curvature of not larger than 0.8 mm/m, which significantly improves the dimensional accuracy and surface quality of the seamless tube.

DETAILED DESCRIPTION OF THE EMBODIMENTS

The present disclosure provides a superalloy seamless tube, comprising the following components in percentages by weight: C: 0.01-0.06%, Si: 0.40-1.00%, Mn: 0.30-1.00%, P≤0.025%, S≤0.020%, Cr: 15.00-17.00%, Ni: 44.00-46.00%, Al: 2.90-3.90%, Ce: 0.01-0.03%, Ti: 0.10-0.30%, N: 0.03-0.08%, and the balance of Fe and inevitable impurities.

In some embodiments, the superalloy seamless tube provided by the present disclosure comprises in percentages by weight, 0.01-0.06% of C, preferably 0.03-0.06% of C, and more preferably 0.04-0.05% of C.

In some embodiments, the superalloy seamless tube provided by the present disclosure comprises in percentages by weight, 0.40-1.00% of Si, preferably 0.50-0.90% of Si, and more preferably 0.60-0.80% of Si.

In some embodiments, the superalloy seamless tube provided by the present disclosure comprises in percentages by weight, 0.30-1.00% of Mn, preferably 0.40-0.90% of Mn, and more preferably 0.50-0.80% of Mn.

In some embodiments, the superalloy seamless tube provided by the present disclosure comprises in percentages by weight, P: ≤0.025%, preferably 0.005-0.02% of P, and more preferably 0.01-0.015% of P.

In some embodiments, the superalloy seamless tube provided by the present disclosure comprises in percentages by weight, S: ≤0.020%, preferably 0.005-0.015% of S, and more preferably 0.07-0.012% of S.

In some embodiments, the superalloy seamless tube provided by the present disclosure comprises in percentages by weight, 15.00-17.00% of Cr, preferably 15.5-16.5% of Cr, and more preferably 15.8-16.2% of Cr.

In some embodiments, the superalloy seamless tube provided by the present disclosure comprises in percentages by weight, 44.00-46.00% of Ni, preferably 45.00-46.00% of Ni, and more preferably 45.50-46% of Ni.

In some embodiments, the superalloy seamless tube provided by the present disclosure comprises in percentages by weight, 2.90-3.90% of Al, preferably 2.95-3.50% of Al, and more preferably 3.00-3.30% of Al.

In some embodiments, the superalloy seamless tube provided by the present disclosure comprises in percentages by weight, 0.01-0.03% of Ce, preferably 0.015-0.025% of Ce, and more preferably 0.017-0.023% of Ce.

In some embodiments, the superalloy seamless tube provided by the present disclosure comprises in percentages by weight, 0.10-0.300% of Ti, preferably 0.15-0.25% of Ti, and more preferably 0.18-0.23% of Ti.

In some embodiments, the superalloy seamless tube provided by the present disclosure comprises in percentages by weight, 0.03-0.08% of N, preferably 0.03-0.07% of N, and more preferably 0.05-0.07% of N.

In some embodiments, the superalloy seamless tube provided by the present disclosure comprises the balance of Fe and inevitable impurities.

Compared with GH2747 alloy, the superalloy seamless tube of the present disclosure has reduced C content such that its intergranular corrosion resistance is improved; with Si and Mn contents controlled within a certain range and N element increased by a certain amount, the decrease in strength caused by the reduced C content could be compensated; in addition, the appropriate amount of Al and Ti added in the superalloy seamless tube, in combination with other components could reduce grain boundary precipitates, and meanwhile produce carbides of Ti in a certain amount, thereby reducing the C content in the matrix and improving intergranular corrosion resistance of the seamless tube; a small amount of rare earth Ce added, in combination with other components, could reduce the amount of non-metallic inclusions in the alloy and reduce their dimension, thus purifying the melt and helping to improve the processing and use performance. In the present disclosure, the combined effect of each component makes the superalloy seamless tube have high temperature resistance, oxidation corrosion resistance, high tensile strength and high yield strength, which can fully meet the mechanical performance requirements for the superalloy seamless tubes in terms of aerospace engines.

In some embodiments, the superalloy seamless tube has an inner surface roughness Ra of not larger than 1.6 μm, an outer surface roughness Ra of not larger than 1.0 μm, an outer diameter of 25±0.05 mm, for example 25 mm, a wall thickness of 3±0.05 mm, for example 3 mm, a curvature of not larger than 0.8 mm/m, and a grain size of not less than grade 5.

In some embodiments, the superalloy seamless tube exhibits the following room-temperature mechanical properties: $R_m \geq 600$ MPa, $R_{p0.2} \geq 210$ MPa, $A_{50} \geq 35\%$, and for example, $R_m$ of 650 MPa, $R_{p0.2}$ of 280 MPa, $A_{50}$ of 45%.

In some embodiments, the superalloy seamless tube exhibits the following high-temperature mechanical properties:

- at 100° C., $R_m \geq 540$ MPa, $R_{p0.2} \geq 195$ MPa, $A \geq 35\%$, and for example $R_m$ of 590 MPa, $R_{p0.2}$ of 235 MPa, $A_{50}$ of 45%;
- at 200° C., $R_m \geq 530$ MPa, $R_{p0.2} \geq 190$ MPa, $A \geq 35\%$, and for example $R_m$ of 580 MPa, $R_{p0.2}$ of 210 MPa, $A_{50}$ of 46%;
- at 300° C., $R_m \geq 520$ MPa, $R_{p0.2} \geq 170$ MPa, $A \geq 40\%$, and for example $R_m$ of 570 MPa, $R_{p0.2}$ of 180 MPa, $A_{50}$ of 48%;
- at 400° C., $R_m \geq 510$ MPa, $R_{p0.2} \geq 160$ MPa, $A \geq 40\%$, and for example $R_m$ of 560 MPa, $R_{p0.2}$ of 170 MPa, $A_{50}$ of 50%;
- at 500° C., $R_m \geq 480$ MPa, $R_{p0.2} \geq 150$ MPa, $A \geq 45\%$, and for example $R_m$ of 540 MPa, $R_{p0.2}$ of 160 MPa, $A_{50}$ of 50%;
- at 600° C. $R_m \geq 420$ MPa, $R_{p0.2} \geq 150$ MPa, $A \geq 25\%$, and for example $R_m$ of 450 MPa, $R_{p0.2}$ of 180 MPa, $A_{50}$ of 20%;
- at 700° C., $R_m \geq 320$ MPa, $R_{p0.2} \geq 150$ MPa, $A \geq 10\%$, and for example $R_m$ of 350 MPa, $R_{p0.2}$ of 210 MPa, $A_{50}$ of 10%;
- at 800° C., $R_m \geq 150$ MPa, $R_{p0.2} \geq 140$ MPa, $A \geq 50\%$, and for example $R_m$ of 180 MPa, $R_{p0.2}$ of 160 MPa, $A_{50}$ of 60%;
- at 900° C. $R_m \geq 80$ MPa, $R_{p0.2} \geq 70$ MPa, $A \geq 50\%$, and for example $R_m$ of 90 MPa, $R_{p0.2}$ of 80 MPa, $A_{50}$ of 65%.

In the present disclosure, $R_m$ refers to tensile strength, $R_{p0.2}$ refers to yield strength, and $A_{50}$ refers to elongation after fracture.

The present disclosure provides a method for preparing the superalloy seamless tube as described in the above technical solutions, comprising:

(1) smelting and forging an alloy for achieving components of the superalloy seamless tube as described in the above technical solutions, to obtain a tube blank;
(2) subjecting the tube blank to a hot piercing, to obtain a crude tube;
(3) subjecting the crude tube to a first solution heat treatment and a cold rolling in sequence, to obtain an intermediate tube blank;
(4) subjecting the intermediate tube blank to a second solution heat treatment and a cold rolling in sequence, to obtain a preliminary alloy tube; and
(5) subjecting the preliminary alloy tube to a third solution heat treatment, to obtain a superalloy seamless tube.

In the present disclosure, the alloy for achieving components of the superalloy seamless tube as described in the above technical solutions is smelted and forged to obtain a tube blank.

There is no special limitation to the source of the alloy for achieving components of the superalloy seamless tube as described in the above technical solutions, which may be prepared by methods well known in the art. In some embodiments of the present disclosure, the melting comprises a vacuum induction smelting and an electroslag remelting smelting in sequence. There are no special requirements for the specific implementation of the vacuum induction smelting and the electroslag remelting smelting, and those well known in the art may be used. In some embodiments of the present disclosure, the tube obtained after the vacuum induction smelting has a dimension of Φ430×2800 mm; in some embodiments, an electroslag ingot obtained after the electroslag remelting smelting has an outer diameter of 510 mm. In the present disclosure, the tube and the electroslag ingot may be obtained by means well known in the art. There are no special requirements for the forging means, and means well known in the art for forging the tube blank may be used. In specific embodiments of the present disclosure, the electroslag ingots obtained after the electroslag remelting smelting are quickly forged and cogged into 220 octagonal blanks, with a rapid forging compression ratio≥5, a head removing of 3%, and a tail removing of 8%, subjected to an inspection and a grinding, then radially forged into a tube blank. In some embodiments of the present disclosure, the tube blank has an outer diameter of 70 mm.

After the tube blank is obtained, the tube blank is subjected to a hot piercing, to obtain a crude tube.

In some embodiments, before the hot piercing, the method according to the present disclosure further comprises subjecting the tube blank to a fine stripping to remove an oxide scale and surface defects on the surface of the tube blank. There is no special requirements for the specific implementation of the fine stripping, and fine stripping means well known in the art may be used. After the fine stripping and before the hot piercing, in some embodiments of the present disclosure, the tube blank after the fine stripping is cut into sections, each of which is drilled with a 012±1 mm centering hole at one end thereof, to prevent the unevenness in wall thickness during the hot piercing. There is no special limitation to the length of each section of the tube blank, and those skilled in the art can adjust it according to actual needs. In specific embodiments of the present disclosure, each section of the tube blank has a length of 1200-1300 mm. There are no special requirements for the specific implementation of the hot piercing, and hot piercing means well known in the art may be used. In some embodiments of the present disclosure, the crude tube has a dimension of Φ70×7 mm. A Φ12±1 mm centering hole drilled at one end of each blank can help to control the outer-diameter deviation of the tube in a range of (−1.50, +1.00) mm, and the wall-thickness deviation in a range of ±0.50 mm.

After the crude tube is obtained, the crude tube is subjected to a first solution heat treatment and a cold rolling in sequence, to obtain an intermediate tube blank.

In some embodiments of the present disclosure, the first solution heat treatment is performed at a temperature of 1000-1060° C., for example 1050° C. In some embodiments, the first solution heat treatment is performed for 25-30 minutes, for example 30 minutes. In some embodiments, the cooling in the solution heat treatment is carried out by a water cooling. The first solution treatment of the present disclosure can improve the plasticity and toughness of the crude tube, and is beneficial to the deformation in the subsequent cold rolling.

In some embodiments of the present disclosure, during the cold rolling of the material obtained by the first solution heat treatment, the deformation of the cold rolling is in a range of 60-70%, and the cold rolling is performed at a feed rate of 2-3 mm/time, for example 3 mm/time; in some embodiments, the cold rolling is performed at a speed of 20-30 times/minute, for example 22-28 times/minute. In some embodiments, the cold rolling of the crude tube is performed by a precision matching of the pass shape with the mandrel in the cold-rolling tube mill. The cold rolling in the present disclosure can reduce the diameter and wall thickness of the crude tube, and extend the crude tube, such that the outer diameter and wall thickness are close to the dimension of the finished tube, thus eliminating the unevenness in longitudinal wall thickness, improving the quality of the inner and outer surface of the alloy tube, and controlling the outer diameter and out-of-roundness thereof. In some embodiments of the present disclosure, the intermediate tube blank has a dimension of Φ38×4 mm. By controlling the cold rolling parameters within the above range, it is beneficial to control the outer-diameter deviation of the tube in a range of ±0.15 mm and the wall-thickness deviation in a range of ±0.1 mm.

After the intermediate tube blank is obtained, the intermediate tube blank is subjected to a second solution heat treatment and a cold rolling in sequence, to obtain a preliminary alloy tube.

In some embodiments, before the second solution heat treatment, the intermediate tube blank is subjected to a first acid pickling. In some embodiments of the present disclosure, the acid used in the first acid pickling is a mixture of hydrofluoric acid and nitric acid; in some embodiments, a mass concentration of hydrofluoric acid in the mixed liquid is in a range of 1-3%, for example 1%; in some embodiments, a mass concentration of nitric acid in the mixed liquid is in a range of 10-15%, for example 11-14%. The first acid pickling in the present disclosure is to remove oil stains on the surface of the intermediate tube blank.

In the present disclosure, the second solution heat treatment is performed at a temperature of 1000-1060° C., for example 1050° C.; the second solution heat treatment is performed for 8-12 minutes, for example 10 minutes; the cooling in the second solution heat treatment is carried out by a water cooling. The second solution heat treatment in the present disclosure can improve the plasticity and toughness of the intermediate tube blank, eliminate the cold-work hardening caused by the cold rolling, and facilitate further cold working.

After the heat-treated intermediate tube blank is obtained, the heat-treated intermediate tube blank is subjected to a cold rolling, to obtain a preliminary alloy tube.

In some embodiments of the present disclosure, the deformation of the cold rolling is in a range of 50-60%. In some embodiments, the cold rolling is performed at a feed rate of 2-3 mm/time, for example 2 mm/time. In some embodiments, the cold rolling is performed at a speed of 20-30 times/minute, for example 22-28 times/minute. In some embodiments of the present disclosure, the cold rolling of the crude tube is performed by a precise matching of the pass shape with the mandrel in the cold-rolling tube mill. The cold rolling in the present disclosure can reduce the diameter and wall thickness of the intermediate tube blank, and extend the intermediate tube blank, such that the outer diameter and wall thickness thereof is to be the dimension of the finished tube, thereby eliminating the unevenness in longitudinal wall thickness, improving the inner and outer surface quality of the alloy tube, and controlling the outer diameter and out-of-roundness thereof. In some embodiments of the present disclosure, the preliminary alloy tube has a dimension of Φ25×3 mm. The precise matching of the pass shape with the mandrel, and the controlling cold rolling parameters within the above range make the outer-diameter deviation of the alloy tube in a range of ±0.05 mm, and the wall-thickness deviation in a range of ±0.05 mm.

In some embodiments, before the cold rolling, the method according to the present disclosure further comprises subjecting the heat-treated intermediate tube blank to a straightening, a second acid pickling, a surface inspection, a grinding, and a cleaning in sequence. There are no special requirements for the specific implementations of the straightening, the second acid pickling, the surface inspection, the grinding and the cleaning, and means well known to those skilled in the art for the straightening, the second acid pickling, the surface inspection, the grinding and the cleaning may be used. In some embodiments of the present disclosure, the straightening is performed with a multi-roll straightening machine, and in some embodiments, the straightness of the intermediate tube blank is controlled not larger than 1.0 mm/m. In some embodiments of the present disclosure, the acid used in the second acid pickling is a mixed liquid of hydrofluoric acid and nitric acid; in some embodiments, a mass concentration of hydrofluoric acid in the mixed liquid is in a range of 5-8%, for example 6-7%; in some embodiments, a mass concentration of nitric acid in the mixed liquid is in a range of 10-15%, for example 11-14%.

The method according to the present disclosure comprises two cold rollings. After the first cold rolling, the unevenness in wall thickness is greatly improved, but there is still a certain deviation. Then the second cold rolling is performed, with a smaller deformation, and thus the unevenness in wall thickness is further improved, whereby the deviation range of the dimension of the finished product could be achieved.

After the preliminary alloy tube is obtained, the preliminary alloy tube is subjected to a third solution heat treatment, to obtain a superalloy seamless tube.

In some embodiments of the present disclosure, before the third solution heat treatment, the method further comprises subjecting the preliminary alloy tube to a third acid pickling. In some embodiments, the acid used in the third acid pickling is the same as those used in the first acid pickling, and will not be repeated herein. The third acid pickling in the present disclosure is to remove oil stains on the surface of the alloy tube.

In some embodiments of the present disclosure, the third solution heat treatment is performed at a temperature of 1000-1060° C., for example 1020° C. In some embodiments, the third solution heat treatment is performed for 5-10 minutes, for example 8 minutes. In some embodiments, the cooling in the third solution heat treatment is carried by a water cooling. The third solution heat treatment in the present disclosure makes the alloy tube recrystallize, thereby improving the plasticity and toughness of the alloy tube, and finally obtaining good comprehensive performances.

After the third solution heat treatment, in some embodiments, the method according to the present disclosure further comprises subjecting the alloy tube after the third solution heat treatment to a post-treatment and an inspection.

In some embodiments of the present disclosure, the post-treatment comprises a straightening and a fine polishing in sequence. There are no special requirements for the specific implementation of the straightening and the fine polishing, and means well known to those skilled in the art for the straightening and the fine polishing may be used. In some embodiments of the present disclosure, the post-processed finished tube is straightened by a multi-roll straightening machine, and the straightness of the finished tube after the straightening is not larger than 0.8 mm/m.

In some embodiments of the present disclosure, the inspection comprises an ultrasonic inspection, an eddy current inspection, a hydraulic inspection, a surface inspection, a dimension inspection and a physical-chemical inspection. The specific implementations of the inspections in the present disclosure are all means known in the art, and will not be repeated here.

Under the premise of ensuring the performance of the prepared seamless tube, the method of the present disclosure can ensure that the prepared seamless tube has good dimensional accuracy and surface quality, and thus the method is suitable for industrialized production.

The superalloy seamless tube provided by the present disclosure and the preparation method thereof will be described in detail below with reference to the examples, which cannot be understood to limit the protection scope of the present disclosure.

Example 1

Superalloy seamless tubes comprise the following components in percentages by weight: C: 0.036%, Si: 0.56%, Mn: 0.42%, P: 0.014%, S: 0.012%, Cr: 16.02%, Ni: 45.92%, Al: 3.11%, Ce: 0.023%, Ti: 0.18%, N: 0.05%, Fe: 33.52% and other inevitable impurities.

The superalloy seamless tubes were prepared as follows:

(1) the alloy was smelted by a vacuum induction smelting and an electroslag remelting smelting, and finally hot forged into Φ70 mm tube blanks;

(2) the forged blanks obtained in step (1) were finely stripped, and then cut into a certain length, namely 1200-1250 mm, with a Φ12±1 mm centering hole drilled at one end of each blank, and then subjected to a hot piercing, obtaining Φ70×7 mm crude tubes, with an outer-diameter deviation of (−1.50, +1.00) mm, and a wall-thickness deviation of ±0.50 mm;

(3) the crude tubes obtained in step (2) were subjected to a solution heat treatment at 1050° C. and maintained for 30 minutes, followed by a water cooling; the heat-treated alloy tubes were cold-rolled to Φ38×4 mm intermediate tube blanks, with an outer-diameter deviation of ±0.15 mm, and a wall-thickness deviation of 0.1 mm;

(4) the intermediate tubes treated in step (3) were subjected to an acid pickling and a solution heat treatment (in which the solution heat treatment was performed at 1050° C. and maintained for 10 minutes, followed by a water cooling), and then subjected to a straightening, an acid pickling, a surface inspection, a grinding, and a cleaning;

(5) the alloy tubes obtained in step (5) were cold rolled to Φ25×3 mm finished alloy tubes, with an outer-diameter deviation of ±0.05 mm, and a wall-thickness deviation of ±0.05 mm, and then pickled with an acid; and (6) the acid-pickled alloy tubes were subjected to a solution heat treatment, in which the heat treatment was performed at 1020° C. and maintained for 8 minutes, followed by an air cooling;

The alloy tubes were straightened, and finally the inner and outer surfaces of the alloy tubes were finely polished. The finely polished alloy tubes were subjected to an ultrasonic inspection, an eddy current inspection, a hydraulic inspection, a surface inspection, a dimension inspection, a physical-chemical inspection, etc.

One superalloy seamless tube as prepared in Example 1 was randomly selected, and different parts of the seamless tube were randomly measured, with the following results: an inner surface roughness Ra of 0.8-1.2 μm, an outer surface roughness Ra of 0.5-0.8 μm, an outer diameter in a range of 25±0.05 mm, a wall thickness in a range of 3±0.05 mm, a curvature of not larger than 0.8 mm/m, and a grain size of grade 5.5. The mechanical properties of the selected seamless tube were tested. The room-temperature mechanical properties were as follows: $R_m$=660 MPa, $R_{p0.2}$=286 MPa, A=46.5%, where $R_m$ refers to tensile strength, $R_{p0.2}$ refers to yield strength, and A refers to elongation after fracture. The mechanical properties were as follows: at 100° C., $R_m$=600 MPa, $R_{p0.2}$=241 MPa, A=50.0%; at 200° C., $R_m$=586 MPa, $R_{p0.2}$=212 MPa, A=50.5%; at 300° C., $R_m$=580 MPa, $R_{p0.2}$=189 MPa, A=51.5%; at 400° C., $R_m$=576 MPa, $R_{p0.2}$=181 MPa, A=54.5%; at 500° C., $R_m$=542 MPa, $R_{p0.2}$=170 MPa, A=60.0%; at 600° C., $R_m$=460 MPa, $R_{p0.2}$=200 MPa, A=28.5%; at 700° C., $R_m$=354 MPa, $R_{p0.2}$=238 MPa, A=11.5%; at 800° C., $R_m$=182 MPa, $R_{p0.2}$=166 MPa, A=71.5%; at 900° C., $R_m$=95 MPa, $R_{p0.2}$=84 MPa, A=74.0%. Vickers hardness: $HV_{30}$=136. A flattening and flaring test was performed according to ASME SA-1016/SA-1016M, and no fractures or cracks occurred. Intergranular corrosion test was performed by Method B in GB/T 15260 (copper-copper sulfate-16% sulfuric acid), in which the alloy tube was exposed to a boiling solution for 72 hours, and there was no tendency for the intergranular corrosion.

Example 2

Superalloy seamless tubes comprise the following components in percentages by weight: C: 0.042%, Si: 0.61%, Mn: 0.41%, P: 0.013%, S: 0.008%, Cr: 16.06%, Ni: 45.96%, Al: 3.02%, Ce: 0.019%, Ti: 0.16%, N: 0.06%, Fe: 33.48% and other inevitable impurities.

The superalloy seamless tubes were prepared as follows:

(1) the alloy was smelted by a induction smelting and an electroslag remelting smelting, and finally hot forged into Φ70 mm tube blanks;

(2) the forged blanks obtained in step (1) were finely stripped, and then cut into a certain length, namely 1200-1250 mm, with a Φ12±1 mm centering hole drilled at one end of each blank, and then subjected to a hot piercing, obtaining Φ70×7 mm crude tubes, with an outer-diameter deviation of (−1.50, +1.00) mm, and a wall-thickness deviation of ±0.50 mm;

(3) the crude tubes obtained in step (2) were subjected to a solution heat treatment (in which the heat treatment was performed at 1050° C. and maintained for 30 minutes, followed by a water cooling); the heat-treated alloy tubes were cold-rolled to Φ38×4 mm intermediate tube blanks, with an outer-diameter deviation of 0.15 mm, and a wall-thickness deviation of 0.1 mm;

(4) the intermediate tubes treated in step (3) were subjected to an acid pickling and a solution heat treatment (in which the solution heat treatment was performed at 1050° C. and maintained for 10 minutes, followed by a water cooling), and then subjected to a straightening, an acid pickling, a surface inspection, a grinding, and a cleaning;

(5) the alloy tubes obtained in step (4) were cold rolled to Φ25×3 mm finished alloy tubes, with an outer-diameter deviation of ±0.05 mm, and a wall-thickness deviation of ±0.05 mm, and then pickled with an acid; and (6) the acid-pickled alloy tubes were subjected to a solution heat treatment, in which the heat treatment was performed at 1020° C. and maintained for 8 minutes, followed by an air cooling.

The alloy tubes were straightened, and finally the inner and outer surfaces of the alloy tube were finely polished. The finely polished alloy tubes were subjected to an ultrasonic inspection, an eddy current inspection, a hydraulic inspection, a surface inspection, a dimension inspection, a physical-chemical inspection, etc.

One superalloy seamless tube as prepared in Example 2 was randomly selected, and different parts of the seamless tube were randomly measured, with the following results: an inner surface roughness Ra of 0.9-1.5 μm, an outer surface roughness Ra of 0.4-0.7 μm, an outer diameter in a range of 25±0.05 mm, a wall thickness of 3±0.05 mm, a curvature not larger than 0.7 mm/m, and a grain size of grade 5.1. The mechanical properties of the selected seamless tube were tested. The room-temperature mechanical properties were as follows: $R_m$=655 MPa, $R_{p0.2}$=283 MPa, A=46.0%, where $R_m$ refers to tensile strength, $R_{p0.2}$ refers to yield strength, and A refers to elongation after fracture. The high-temperature mechanical properties were as follows: at 100° C., $R_m$=603 MPa, $R_{p0.2}$=243 MPa, A=49.5%; at 200° C., $R_m$=588 MPa, $R_{p0.2}$=219 MPa, A=52.0%; at 300° C., $R_m$=574 MPa, $R_{p0.2}$=191 MPa, A=51.5%; at 400° C., $R_m$=566 MPa, $R_{p0.2}$=182 MPa, A=54.0%; at 500° C., $R_m$=539 MPa, $R_{p0.2}$=173 MPa, A=59.5%; at 600° C., $R_m$=467 MPa, $R_{p0.2}$=201 MPa, A=29.0%, at 700° C.; $R_m$=356 MPa, $R_{p0.2}$=235 MPa, A=13.5%; at 800° C., $R_m$=183 MPa, $R_{p0.2}$=162 MPa, A=71.0%; at 900° C., $R_m$=98 MPa, $R_{p0.2}$=82 MPa, A=72.5%. Vickers hardness: $HV_{30}$=144.

A flattening and flaring test were performed according to ASME SA-1016/SA-1016M, and no fractures or cracks occurred, The intergranular corrosion test was performed by Method B in GB/T 15260 (copper—copper sulfate—16% sulfuric acid), in which the alloy tube was exposed to a boiling solution for 72 hours, and there was no tendency for intergranular corrosion.

Comparative Example 1

Comparative Example 1 differed from Example 2 only in that the superalloy seamless tubes were free from elements Ti and N.

Superalloy seamless tubes comprise the following components in percentages by weight: C: 0.042%, Si: 0.61%, Mn: 0.41%, P: 0.013%, S: 0.008%, Cr: 16.06%, Ni: 45.96%, Al: 3.02%, Ce: 0.019%, Fe: 33.58% and other inevitable impurities.

The superalloy seamless tubes were prepared as follows:

(1) the alloy was smelted by a vacuum induction smelting and an electroslag remelting smelting, and finally hot forged into 0Φ70 mm tube blanks;

(2) the forged blanks obtained in step (1) were finely stripped, and then cut into a certain length, namely 1200-1250 mm, with a Φ12±1 mm centering hole drilled at one end of each blank, and then subjected to a hot piercing to obtain Φ70×7 mm crude tubes, with an outer-diameter deviation of (−1.50, +1.00) mm, and a wall-thickness deviation of ±0.50 mm;

(3) the crude tubes obtained in step (2) were subjected to a solution heat treatment (in which the heat treatment was performed at 1050° C. and maintained for 30 minutes, followed by a water cooling); the heat-treated alloy tubes were cold-rolled to Φ38×4 mm intermediate tube blanks, with an outer-diameter deviation of 0.15 mm, and a wall-thickness deviation of 0.1 mm;

(4) the intermediate tubes treated in step (3) were subjected to an acid pickling and a solution heat treatment (in which the solution heat treatment was performed at 1050° C. and maintained for 10 minutes, followed by a water cooling), and then subjected to a straightening, an acid pickling, a surface inspection, a grinding, and a cleaning;

(5) the alloy tubes obtained in step (4) were cold rolled to Φ25×3 mm finished alloy tubes, with an outer-diameter deviation of ±0.05 mm, and a wall-thickness deviation of ±0.05 mm, and then pickled with an acid;

(6) the acid-pickled alloy tubes were subjected to a solution heat treatment, in which the heat treatment was performed at 1020° C. and maintained for 8 minutes, followed by an air cooling.

The alloy tubes were straightened, and finally the inner and outer surfaces of the alloy tube were finely polished. The finely polished alloy tubes were subjected to an ultrasonic inspection, an eddy current inspection, a hydraulic inspection, a surface inspection, a dimension inspection, a physical-chemical inspection, etc.

One superalloy seamless tube as prepared in Comparative Example 1 was randomly selected, and different parts of the seamless tube were randomly measured, with the following results: an inner surface roughness Ra of 0.9-1.5 μm, an outer surface roughness Ra of 0.4-0.7 μm, an outer diameter in a range of 25±0.05 mm, a wall thickness in a range of 3±0.05 mm, a curvature of not larger than 0.7 mm/m, and a grain size of grade 5.1. The mechanical properties of the selected seamless tube were tested. The room-temperature mechanical properties were as follows: $R_m$=645 MPa, $R_{p0.2}$=276 MPa, A=42.0%, where $R_m$ refers to tensile strength, $R_{p0.2}$ refers to yield strength, and A refers to elongation after fracture.

The high-temperature mechanical properties were as follows: at 100° C., $R_m$=592 MPa, $R_{p0.2}$=236 MPa, A=47.5%; at 200° C., $R_m$=576 MPa, $R_{p0.2}$=205 MPa, A=50.5%; at 300° C., $R_m$=563 MPa, $R_{p0.2}$=182 MPa, A=50.5%; at 400° C., $R_m$=552 MPa, $R_{p0.2}$=174 MPa, A=51.5%; at 500° C., $R_m$=523 MPa, $R_{p0.2}$=165 MPa, A=55.5%; at 600° C., $R_m$=452 MPa, $R_{p0.2}$=196 MPa, A=28.0%; at 700° C., $R_m$=342 MPa, $R_{p0.2}$=223 MPa, A=12.0%; at 800° C., $R_m$=175 MPa, $R_{p0.2}$=156 MPa, A=69.0%; at 900° C., $R_m$=89 MPa, $R_{p0.2}$=78 MPa, A=70.5%. Vickers hardness:

$HV_{30}$=143. A flattening and flaring test were performed according to ASME SA-1016/SA-1016M, and no fractures or cracks occurred. The intergranular corrosion test was performed by Method B (copper—copper sulfate 16% sulfuric acid) in GB/T 15260, in which the alloy tube was exposed to a boiling solution for 72 hours, and there was a tendency for intergranular corrosion.

From the results of Comparative Example 1 and Example 2, it can be seen that the intergranular corrosion resistance and the mechanical properties of the seamless tube were improved by adding appropriate amount of Ti and N.

It can be seen from the above examples that the superalloy seamless pipe as prepared in the present disclosure has excellent high temperature resistance, oxidation corrosion resistance, high tensile strength and high yield strength, and has a low roughness, small wall-thickness and outer-diameter deviation and a low curvature, indicating that the superalloy seamless pipe has good dimensional accuracy and surface quality, and can fully meet the requirements for superalloy seamless tubes in terms of aerospace engines.

The description of the above embodiments is only used to help understand the method and core idea of the present disclosure. It should be pointed out that for those skilled in the art, without departing from the principle of the present disclosure, several improvements and modifications can be made to the present disclosure, and these improvements and modifications also fall within the protection scope of the claims of the present disclosure. Various modifications to these embodiments are obvious to those skilled in the art, and the general principles defined herein can be implemented in other embodiments without departing from the spirit or scope of the present disclosure. Therefore, the present disclosure will not be limited to the embodiments shown in this text, but should conform to the widest scope consistent with the principles and novel features disclosed in this text.

What is claimed is:

1. A method for preparing a superalloy seamless tube, the superalloy seamless tube consisting of the following components in percentages by weight: C: 0.01-0.06%, Si: 0.40-1.00%, Mn: 0.30-1.00%, P≤0.025%, S≤0.020%, Cr: 15.00-17.00%, Ni: 44.00-46.00%, Al: 2.90-3.90%, Ce: 0.01-0.03%, Ti: 0.10-0.30%, N: 0.03-0.08%, and the balance being Fe and inevitable impurities;

the method comprising:

(1) smelting and forging an alloy for achieving components of the superalloy seamless tube, to obtain a tube blank;

(2) subjecting the tube blank to a hot piercing, to obtain a crude tube;

(3) subjecting the crude tube to a first solution heat treatment and a cold rolling in sequence, to obtain an intermediate tube blank;

(4) subjecting the intermediate tube blank to a second solution heat treatment and a cold rolling in sequence, to obtain a preliminary alloy tube; and (5) subjecting the preliminary alloy tube to a third solution heat treatment, to obtain a superalloy seamless tube.

2. The method as claimed in claim 1, wherein in step (1), the tube blank has an outer diameter of 70 mm;

in step (2), the crude tube has a dimension of Φ70×7 mm, an outer-diameter deviation of −1.50 mm to +1.00 mm, and a wall-thickness deviation of ±0.50 mm;

in step (3), the intermediate tube blank has a dimension of Φ38×4 mm, an outer-diameter deviation of ±0.15 mm, and a wall-thickness deviation of ±0.1 mm;

in step (4), the preliminary alloy tube has a dimension of Φ25×3 mm, an outer-diameter deviation of ±0.05 mm, and a wall-thickness deviation of ±0.05 mm.

3. The method as claimed in claim 1, wherein in step (3), the first solution heat treatment is performed at a temperature of 1000-1060° C. for 25-30 minutes, and a cooling in the first solution heat treatment is carried out by a water cooling.

4. The method as claimed in claim 1, wherein in steps (3) and (4), the cold rolling is performed independently at a feed rate of 2-3 mm/time, and independently at a speed of 20-30 times/minute.

5. The method as claimed in claim 1, wherein in step (4), the second solution heat treatment is performed at a temperature of 1000-1060° C. for 8-12 minutes, and a cooling in the second solution heat treatment is carried out by a water cooling.

6. The method as claimed in claim 1, further comprising, in step (4), before the second solution heat treatment, subjecting the intermediate tube blank to a first acid pickling; and further comprising subjecting the intermediate tube blank after the second solution heat treatment to a second acid pickling.

7. The method as claimed in claim 6, wherein an acid used in the first acid pickling is a mixed liquid of hydrofluoric acid and nitric acid, wherein a mass concentration of hydrofluoric acid in the mixed liquid is in a range of 1-3%, and a mass concentration of nitric acid in the mixed liquid is in a range of 10-15%.

8. The method as claimed in claim 6, wherein an acid used in the second acid pickling is a mixed liquid of hydrofluoric acid and nitric acid, wherein a mass concentration of hydrofluoric acid in the mixed liquid is in a range of 5-8%, and a mass concentration of nitric acid in the mixed liquid is in a range of 10-15%.

9. The method as claimed in claim 1, wherein in step (5), the third solution heat treatment is performed at a temperature of 1000-1060° C. for 5-10 minutes, and a cooling in the third solution heat treatment is carried out by a water cooling.

10. The method as claimed in claim 1, further comprising in step (5), before the third solution heat treatment, subjecting the preliminary alloy tube to a third acid pickling, wherein an acid used in the third acid pickling is a mixed liquid of hydrofluoric acid and nitric acid, wherein a mass concentration of hydrofluoric acid in the mixed liquid is in a range of 1-3%, and a mass concentration of nitric acid in the mixed liquid is in a range of 10-15%.

11. The method as claimed in claim 1, further comprising subjecting the alloy tube after the third solution heat treatment to a post-treatment and an inspection, wherein the post-treatment comprises a straightening and a fine polishing in sequence, and the inspection comprises an ultrasonic inspection, an eddy current inspection, a hydraulic inspection, a surface inspection, a dimension inspection, and a physical-chemical inspection.

12. The method as claimed in claim 9, further comprising in step (5), before the third solution heat treatment, subjecting the preliminary alloy tube to a third pickling, wherein an acid liquid used in the third pickling is a mixed liquid of hydrofluoric acid and nitric acid; a mass concentration of hydrofluoric acid in the mixed liquid is in a range of 1-3%; and a mass concentration of nitric acid in the mixed liquid is in a range of 10-15%.

13. The method as claimed in claim 1, wherein the superalloy seamless tube has an inner surface roughness Ra of not larger than 1.6 μm, and an outer surface roughness Ra of not larger than 1.0 μm.

14. The method as claimed in claim 1, wherein the superalloy seamless tube exhibits room-temperature mechanical properties as follows: $R_m \geq 600$ MPa, $R_{p0.2} \geq 210$ MPa, $A_{50} \geq 35\%$.

15. The method as claimed in claim 1, wherein the superalloy seamless tube exhibits high-temperature mechanical properties as follows:

at 100° C., $R_m \geq 540$ MPa, $R_{p0.2} \geq 195$ MPa, $A \geq 35\%$;
at 200° C., $R_m \geq 530$ MPa, $R_{p0.2} \geq 190$ MPa, $A \geq 35\%$;
at 300° C., $R_m \geq 520$ MPa, $R_{p0.2} \geq 170$ MPa, $A \geq 40\%$;
at 400° C., $R_m \geq 510$ MPa, $R_{p0.2} \geq 160$ MPa, $A \geq 40\%$;
at 500° C., $R_m \geq 480$ MPa, $R_{p0.2} \geq 150$ MPa, $A \geq 45\%$;
at 600° C., $R_m \geq 420$ MPa, $R_{p0.2} \geq 150$ MPa, $A \geq 25\%$;
at 700° C., $R_m \geq 320$ MPa, $R_{p0.2} \geq 150$ MPa, $A \geq 10\%$;
at 800° C., $R_m \geq 150$ MPa, $R_{p0.2} \geq 140$ MPa, $A \geq 50\%$; and
at 900° C., $R_m \geq 80$ MPa, $R_{p0.2} \geq 70$ MPa, $A \geq 50\%$.

* * * * *